US007506454B1

(12) United States Patent
Balliet

(10) Patent No.: US 7,506,454 B1
(45) Date of Patent: Mar. 24, 2009

(54) APPARATUS FOR HOLDING A MARKING LINE TO A WORKPIECE

(76) Inventor: James Balliet, 531 S. Main St., Perkasie, PA (US) 18944

( * ) Notice: Subject to any disclaimer, the term of this patent is extended or adjusted under 35 U.S.C. 154(b) by 415 days.

(21) Appl. No.: 11/459,395

(22) Filed: Jul. 24, 2006

(51) Int. Cl.
*B44D 3/38* (2006.01)

(52) U.S. Cl. ..... 33/414

(58) Field of Classification Search ..... 33/1 LE, 33/407, 410, 413, 414
See application file for complete search history.

(56) References Cited

U.S. PATENT DOCUMENTS 845,545 A * 2/1907 Knowles ..... 242/391.2
5,937,532 A * 8/1999 Eirich et al. ..... 33/758
6,082,014 A * 7/2000 Beyers ..... 33/414
6,415,519 B1 * 7/2002 Bennett ..... 33/414
2005/0183277 A1 * 8/2005 Scarborough ..... 33/414
2007/0039195 A1 * 2/2007 Leslie et al. ..... 33/414
2008/0016710 A1 * 1/2008 Vary ..... 33/414

* cited by examiner

*Primary Examiner*—G. Bradley Bennett
(74) *Attorney, Agent, or Firm*—Gregory J. Gore

(57) ABSTRACT

A clip for holding the end of a marking line at the edge of a board or panel to be cut includes opposite-facing planar jaws which grip opposing top and bottom surfaces of the panel. A stop block located between the jaws abuts the edge of the panel and includes for alternate use either planar surfaces lateral to a longitudinal axis of the clip or a V-shaped notch centered along the longitudinal axis. Either the lateral surfaces or the V-shaped notch is used when the cut is to occur from either a side edge or from a corner of the panel respectively.

8 Claims, 1 Drawing Sheet

APPARATUS FOR HOLDING A MARKING LINE TO A WORKPIECE

FIELD OF THE INVENTION

The present invention relates to marking tools for producing cut lines on workpieces. More particularly it relates to a holder which is capable of securing a strike line that leaves a chalk mark on a board along which the board is cut.

BACKGROUND OF THE INVENTION

Large sheets of plywood are commonly used in the home construction and remodeling industry. These boards provide the sheeting material for roofs and the sides of houses. These plywood sheets are usually cut with powered hand-held circular saws. Prior to making the cut, the boards are marked with a snap-type chalk line along which the blade of the saw is advanced that ultimately determines the edge of the cut board. As an alternative, cut lines may be formed by running a pencil or other marking device along a straight edge, however this is impractical with very long cuts which are usually required when cutting large plywood sheets to the correct dimensions and shape.

Applying the chalk line to the plywood board sometimes requires two people, one to hold one end of the chalk line and the other to hold the opposite end and to snap the line against the board. In an attempt to make the operation a single person process, a small nail may be driven at one end where the cut is to occur to hold the end of the chalk line. This is time consuming and because the nail is driven at the edge of the pkywood board, splitting of the plywood often occurs. If an L-shaped bracket is used to hook over the edge of the board, the bracket can easily slip if the line is directed at an angle to the edge such as when a diagonal cut is required to be made. There is therefore a need in the art for a marking line holder to overcome these disadvantages of the prior art.

SUMMARY OF THE INVENTION

The present invention solves the problems in the art with holding of the end of the marking line described above by a unique clip which holds tightly around the side edge of a board to be cut. The clip utilizes resilient opposite-facing planar jaws which grip opposing top and bottom surfaces of the board. Frictional gripping pads are also employed on the inside surfaces of the jaws to help stabilize the clip. A line hook extending first upwardly and then rearwardly from a top plate of the clip is in alignment with a sighting aperture through the top plate and upper jaw which is elongate and extends forwardly. A line groove is formed along the surface of the top plate that serves as a guide for placement of a chalk line. An opening between the jaws of the clip is located at a first end and a rear stop block is located at the opposite, closed end, the clip being of U-shaped cross-section. The stop block abuts the edge of the board when in use and includes both planar surfaces lateral to a longitudinal axis of the clip and a V-shaped notch centered along the longitudinal axis. When the desired cut line occurs from a side edge of the workpiece, the planar lateral surfaces of the rear stop are utilized. When the cut is to occur from a corner of the workpiece, the V-shaped notch is utilized. In either case, the resilience of the spring clip and the abutment of the rear stop along the edge or edges of the workpiece firmly clamp the line-holding apparatus of the invention in proper placement on the workpiece while the chalk line is snapped, whether straight across the workpiece or at an angle. This makes the board-marking process a one-person operation that is quick, easy, and safe which are the main objects of the invention.

From the following drawings and description of the preferred embodiment, it will be appreciated by those of skill in the art that the objects of the invention have been achieved. While the present invention will be described with the reference to a specific embodiment, the following description is illustrative of the invention and is not to be construed as limiting the invention. Various modifications to the present invention can be made to the preferred embodiment by those skilled in the art without departing from the true spirit and scope of the invention. It will be noted here that for better understanding like components are designated by the reference numerals throughout the various figures of drawing which follow.

DESCRIPTION OF THE PREFERRED EMBODIMENT

Figure 1:
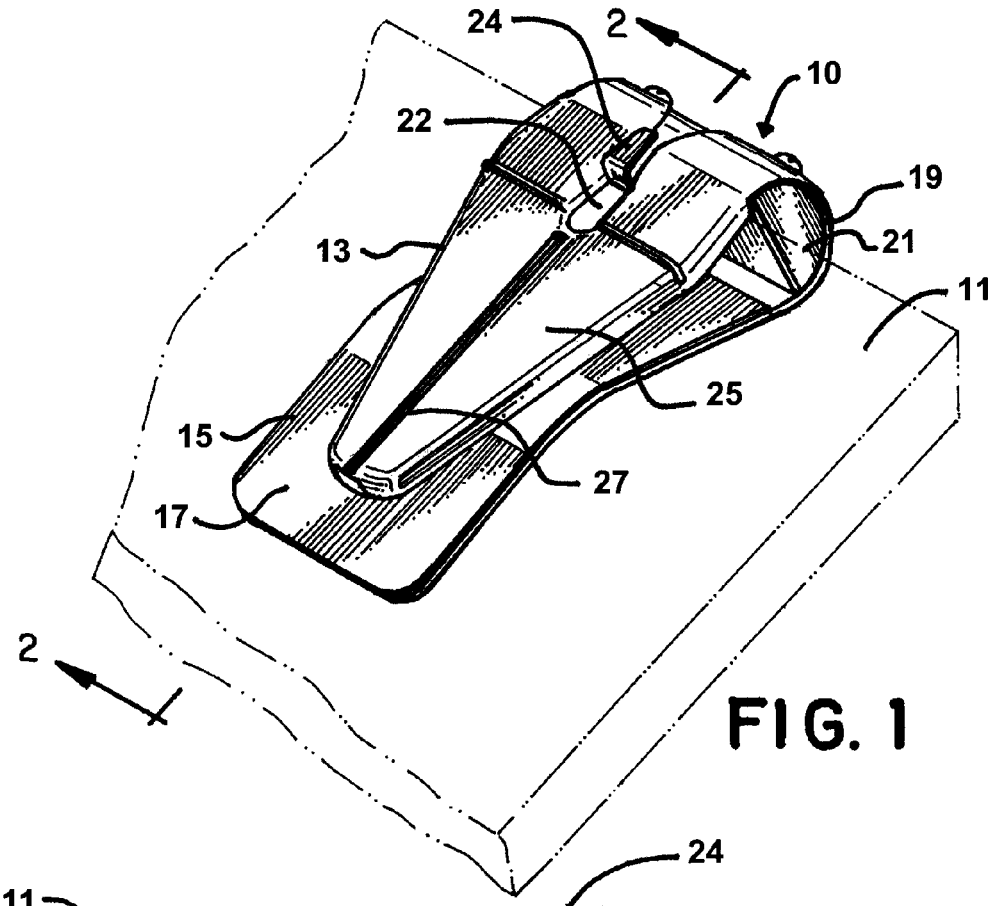
FIG. 1 is a top right front isometric view of the invention shown clamped to a side edge of a board to be cut which is depicted in phantom lines.

Referring now to FIG. 1, the clip-on line holder 10 of the invention is shown firmly fixed around the edge of a board 11. The holder comprises a U-shaped clip formed of resilient material such as spring steel which includes resiliently biased upper and lower jaws 13 and 15 respectively with inner contact surfaces that engage opposite sides of the board 11. The jaws have an opening 17 at a first end for receiving the board 11 when it is applied. A second or opposite end of the clip 19 includes a return bend and a stop block 21 fastened along its inside surface for abutment to a side edge or a corner of the board. A top plate 25 of the clip includes a longitudinal line guide groove 27 along a longitudinal axis of the device. Also lying along the longitudinal axis is a line hook 24 which projects upwardly from the top plate 25. Immediately adjacent the line hook and extending frontally is a mark sighting slot 22 which passes through the top plate 25 and the upper jaw 13 of the clip so that a portion of the top surface of the board 11 along the longitudinal axis of the clip can be viewed.

Figure 2:
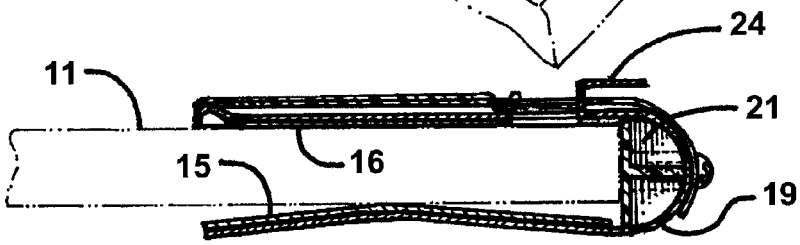
FIG. 2 is a right side sectional elevation view taken from FIG. 1 as shown in that figure.

Referring now to FIG. 2, secured along the inside surfaces of the upper and lower jaws are anti-slip friction pads 15 which forcibly grip opposing top and bottom surfaces of the board 11 to be cut. In the preferred embodiment, the pads 15 are in the form of an abrasive surfaced adhesive tape adhered to the jaws. As depicted in this figure, planar surfaces of the rear stop abut the edge of the board and the rear stop is joined along the inside of the U-shaped return bend at the rear of the clip 19 by screws. Greater detail of the rear stop is shown with regard to FIG. 3.

Figure 3:
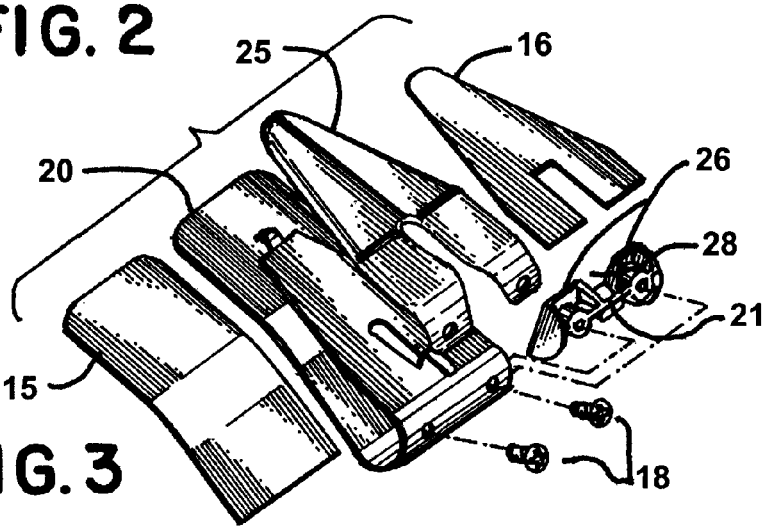
FIG. 3 is a top right rear perspective assembly view showing various elements of the invention in a disassembled state.

Referring now to FIG. 3, an assembly view of the invention is shown in which various components are affixed to the main body of the invention which is in the form of a U-shaped spring clip 20. The anti-slip gripping pads 15 and 16 are affixed to the inside surfaces of the opposing upper and lower jaws of the spring clip by an adhesive. A top plate 25 is added across the outer surfaces of the upper jaw of the spring clip being joined thereto by screws 18 which pass through aligned apertures in the top plate and the back end of the spring clip 20. The same screws also join the stop block 21 to the inside surface of the bend in the clip. The stop block 21 includes coplanar flat surfaces aligned laterally across the longitudinal axis of the clip. The planar surfaces are separated by a V-shaped notch 28 in the center of the block which is of a 90-degree included angle that is bisected by the longitudinal axis of the clip. Surfaces of the rear stop abut either the side edge or a corner of the board to be cut. In the case of a cut line to be marked that passes through the corner point of the board, the point of the corner resides within the notch of the stop block to assist in firmly holding the apparatus in place.

The apparatus of the preferred embodiment as described may be formed from any suitable material such as plastic or metal which enables it to efficiently carry out its function. For example, the material of the spring clip should be such that sufficient resilience is supplied so that the spring clip may be forcibly clamped to the edge of the board to be cut, but yet slidable along the edge. Furthermore, the resilience should be such that a range of board thicknesses that the clip can be applied to be ⅛" to ¾". Although a wooden board is described for the purposes of illustrating the preferred embodiment as the workpiece to be cut, it should be understood that one of the advantages of the invention is that since no part of the apparatus includes an element which penetrates the workpiece, very hard impenetrable workpiece materials such as metal or ceramic tile can be marked using this device.

One embodiment of the invention may be used as follows. The point along the edge of the workpiece where the cut is to be made is first hand-marked. The line holder of the invention is then placed over the mark which may be viewed through the sighting slot and then positioned so that the mark is aligned in the center of the slot and thus also with the longitudinal axis of the holder. The end of the chalk line is connected to the line hook. If the cut is to be made perpendicular to a side edge of the workpiece, the chalk line is extended along the guide groove in the top plate. The other end of the chalk line is positioned over a second hand mark along another edge of the workpiece through which the cut is to pass. When such a placement of the chalk line is achieved, the line is pulled upward and snapped back against the workpiece leaving a straight line mark across the top surface of the workpiece where the cut is to be made. Thus, the present invention holds the chalk line so that one person can easily snap a straight line in any direction. The spring clip secures the holder sufficiently about the edge of the workpiece yet permits the operator to slide it for easy and accurate adjustment of its placement. Furthermore, the holder may fit onto a corner of the workpiece or along any side edge.

It should be understood that there may be other modifications and changes to the present invention that will be obvious to those of skill in the art from the foregoing description, however, the present invention should be limited only by the following claims and their legal equivalents.

What is claimed is:

1. A line holder for marking a workpiece with a chalk line, comprising:

a resilient U-shaped clip having inwardly biased opposing upper and lower jaws and an opening between the jaws at a front end thereof to receive the edge of a workpiece, said clip further including a return bend at a rear end thereof;

a line hook extending upwardly from said upper jaw for securing one end of a workpiece-marking chalk line thereto; and a stop block secured along an inside surface of said clip at said bend, said block including a "V"-shaped notch centered on a longitudinal axis of said clip for abutment with said workpiece edge.

2. The line holder of claim 1 further including a top plate secured to an outside surface of said upper jaw, said top plate having a line guide groove in alignment with said longitudinal axis.

3. The line holder of claim 2 wherein said upper jaw and said top plate include aligned apertures therethrough forming a sighting window for viewing an area of the workpiece lying between the jaws of said clip along said axis.

4. The line holder of claim 3 further including friction enhancing pads secured to inside surfaces of said upper and lower jaws for gripping top and bottom surfaces respectively of said workpiece.

5. The line holder of claim 4 wherein said stop block includes coplanar planar surfaces located on opposite sides of said notch wherein said surfaces lie perpendicular to said axis of said clip.

6. The line holder of claim 5 wherein said stop block is affixed to said clip by screws.

7. The line holder of claim 6 wherein said screws also secure said top plate to said clip.

8. The line holder of claim 4 wherein said friction pads are sections of abrasive-surfaced adhesive tape.

* * * * *